US011047152B2

(12) United States Patent
Shen et al.

(10) Patent No.: US 11,047,152 B2
(45) Date of Patent: Jun. 29, 2021

(54) ELECTRIC LOCK DEVICE

(71) Applicant: SHENZHEN KAADAS INTELLIGENT TECHNOLOGY CO., LTD., Guangdong (CN)

(72) Inventors: Yaoyi Shen, Guangdong (CN); Wenqing Peng, Guangdong (CN); Hanmei Zhang, Guangdong (CN)

(73) Assignee: SHENZHEN KAADAS INTELLIGENT TECHNOLOGY CO., LTD., Shenzhen (CN)

( * ) Notice: Subject to any disclaimer, the term of this patent is extended or adjusted under 35 U.S.C. 154(b) by 279 days.

(21) Appl. No.: 16/430,465

(22) Filed: Jun. 4, 2019

(65) Prior Publication Data

US 2019/0383061 A1 Dec. 19, 2019

(30) Foreign Application Priority Data

Jun. 15, 2018 (CN) ..... 201810621618.8

(51) Int. Cl.

| | |
|---|---|
| ***E05B 47/06*** | (2006.01) |
| ***E05B 47/00*** | (2006.01) |
| ***E05B 47/02*** | (2006.01) |
| ***E05B 63/04*** | (2006.01) |

(52) U.S. Cl.

CPC ..... *E05B 47/0615* (2013.01); *E05B 47/0012* (2013.01); *E05B 2047/002* (2013.01); *E05B 2047/0026* (2013.01); *E05B 2047/0091* (2013.01)

(58) Field of Classification Search

CPC ..... E05B 47/0615; E05B 47/0012; E05B 2047/002; E05B 2047/0026; E05B 2047/0091; E05B 2047/0084; E05B 47/02; E05B 63/04; E05B 2047/0036; E05B 2047/0038

USPC ..... 70/189, 222, 223, 277, 278.7, 279.1, 70/280–282

See application file for complete search history.

(56) References Cited

U.S. PATENT DOCUMENTS

| | | | | |
|---|---|---|---|---|
| 8,365,561 | B2 * | 2/2013 | Chang | E05B 47/026 70/472 |
| 8,490,445 | B2 * | 7/2013 | Chiou | E05B 47/0012 70/279.1 |
| 8,621,900 | B2 * | 1/2014 | Wu | E05B 47/026 70/280 |
| 10,829,957 | B2 * | 11/2020 | McKibben | E05B 47/0012 |

(Continued)

*Primary Examiner* — Lloyd A Gall
(74) *Attorney, Agent, or Firm* — Nixon & Vanderhye , P.C.

(57) ABSTRACT

The present application provides an electric lock device, adopting a clutch mechanism composed of a driven gear and a turntable. The first side of the driven gear is provided with a mounting position for the turntable to be embedded, the sidewall of the mounting position is provided with an arc-shaped recess, and the outer sidewall of the turntable is provided with an arc-shaped bump corresponding to the arc-shaped recess. The central angle corresponding to the arc-shaped recess is denoted as α, and the central angle corresponding to the arc-shaped bump is denoted as β, then α and β satisfy: $\alpha-\beta\geq180°$. Based on the above structure, there is a rotation virtual position greater than or equal to 180° between the driven gear and the turntable, that is, the gear can be rotated at least 180° regardless of the angle to which the gear rotates the turntable.

10 Claims, 9 Drawing Sheets

(56) References Cited

U.S. PATENT DOCUMENTS

2003/0209043 A1* 11/2003 Yeh ..... E05B 47/0012
70/280
2011/0185554 A1* 8/2011 Huang ..... B23P 11/00
29/428
2013/0192316 A1* 8/2013 McKibben ..... E05B 47/02
70/278.1

* cited by examiner

ELECTRIC LOCK DEVICE

CROSS-REFERENCE TO RELATED APPLICATIONS

This application claims priority to Chinese Patent Application No. 201810621618.8 filed on Jun. 15, 2018, the content of which is incorporated herein by reference.

TECHNICAL FIELD

The present application relates to the technical field of lock device, and more particularly to an electric lock device.

BACKGROUND

In addition to be controlled by a motor, the unlocking/locking of the existing electric lock device can also be controlled by manually rotating, which brings some problems: since the lock body and the motor inside the lock device are always connected to each other, when the lock device is manually unlocked/locked, the motor will be reversely driven to generate back electromotive force, which causes interference to the stability of the power supply; moreover, the resistance generated by the motor requires the user to use a large force to twist the lock body, thereby causing poor hand feeling and failing to be quickly locked.

For the above problems, the current electric lock devices on the market are generally provided with a motor retraction mechanism, i.e., after the motor drives the lock body to perform the unlocking/locking action, the motor reverses and retreats, which is completely separated from the lock body, and no longer affects the operation of the manual unlocking/locking. However, the motor retraction mechanism generally has problems such as complicated structure, complicated control logic, and high design cost, thereby not conducive to popularization and application.

SUMMARY

In order to solve the above technical problems, the present application provides an electric lock device, which is provided with a clutch mechanism with a larger angle of retraction, thereby having the advantages of high practicability, good hand feeling in operation, and no interference with the stability of power supply, with simple structure, simple control logic and low design cost.

Based on this, the present application provides an electric lock device, including: a housing, a lock body disposed outside the housing, and a motor and a clutch mechanism disposed inside the housing.

The clutch mechanism comprises a driven gear and a turntable, which are arranged to be coaxial. An output shaft of the motor is provided with a driving gear meshing with the driven gear. A first side of the driven gear defines a mounting position configured for allowing the turntable to be embedded in. A sidewall of the mounting position defines an arc-shaped recess, and an outer sidewall of the turntable defines an arc-shaped bump corresponding to the arc-shaped recess. A central angle corresponding to the arc-shaped recess is denoted as $\alpha$, and a central angle corresponding to the arc-shaped bump is denoted as $\beta$, and $\alpha$ and $\beta$ satisfy: $\alpha-\beta\geq180°$.

The first side of the driven gear is provided with a first flap and a second flap symmetrically arranged about a center line of the arc-shaped recess, and the line connecting the first flap and the second flap passes through the axis center of the driven gear.

A magnetic column is disposed on the turntable, and the magnetic column is located at a center line of the arc-shaped bump.

A circuit board electrically connected to the motor is disposed in the housing, and the circuit board is provided with a first sensor and a second sensor respectively configured for detecting the first flap and the second flap and a third sensor configured for detecting the magnetic column.

The housing is provided with a rotatable knob, and the knob is fixedly connected to the turntable.

The side of the turntable facing away from the driven gear is provided with a paddle configured for controlling the unlocking/locking of the lock body.

Preferably, $\alpha$ and $\beta$ satisfy: $\alpha-\beta=180°$.

Preferably, a straight line passing through the first sensor and perpendicular to the axis of the driven gear is referred to as a first reference line, a straight line passing through the second sensor and perpendicular to the axis of the driven gear is referred to as a second reference line, the first reference line is perpendicular to the second reference line, and the third sensor is located on the second reference line.

Preferably, the knob is provided with a first connection post, a front panel of the housing defines a first mounting hole, which is configured to allow the first connection post to extend in, an axis center position of the driven gear defines a first through hole communicating with the mounting position, a side of the turntable facing the driven gear defines a first slot, and the first connection post passes through the first through hole and is inserted into the first slot.

Preferably, the edge of the first mounting hole is provided with an annular protrusion protruding into the housing, and the driven gear is rotatably sleeved outside the annular protrusion.

Preferably, the paddle is mounted at the turntable by a rotating shaft, the side of the turntable facing away from the driven gear is provided with a second connection post, and an end of the second connection post away from the turntable defines therein a second slot configured for allowing the rotating shaft to be inserted therein.

Preferably, the sidewall of the second slot is provided with a projection, and the outer sidewall of the rotating shaft is provided with a recess portion corresponding to the projection.

Preferably, the circuit board is provided with a second through hole configured for allowing the rotating shaft to pass therethrough, the first sensor and the second sensor are arranged around the second through hole, and the rear panel of the housing defines a second mounting hole configured for allowing the rotating shaft to pass therethrough.

Preferably, the first sensor and the second sensor are both photoelectric couplers.

Preferably, the third sensor is a Hall sensor.

Embodiments of the present application have the following beneficial effects:

The present application provides an electric lock device, which adopts a clutch mechanism composed of a driven gear and a turntable. The first side of the driven gear defines a mounting position configured for allowing the turntable to be embedded in, and the sidewall of the mounting position defines an arc-shaped recess. The outer sidewall of the turntable is provided with an arc-shaped bump corresponding to the arc-shaped recess, the central angle corresponding to the arc-shaped recess is denoted as $\alpha$, and the central angle corresponding to the arc-shaped bump is denoted as β, then α and β satisfy: α−β≥180°. Based on the above structure, a rotation virtual position greater than or equal to 180° exists between the driven gear and the turntable, that is, the gear can be rotated backward by at least 180° regardless of the angle to which the gear rotates the turntable, so as to enable the knob to stay in multiple locations when manually unlocking/locking a lock, having the advantages of high practicability, good hand feeling in operation, and no interference with the stability of power supply, with simple structure, simple control logic and low design cost.

DESCRIPTION OF THE REFERENCE SIGNS

Figure 1:
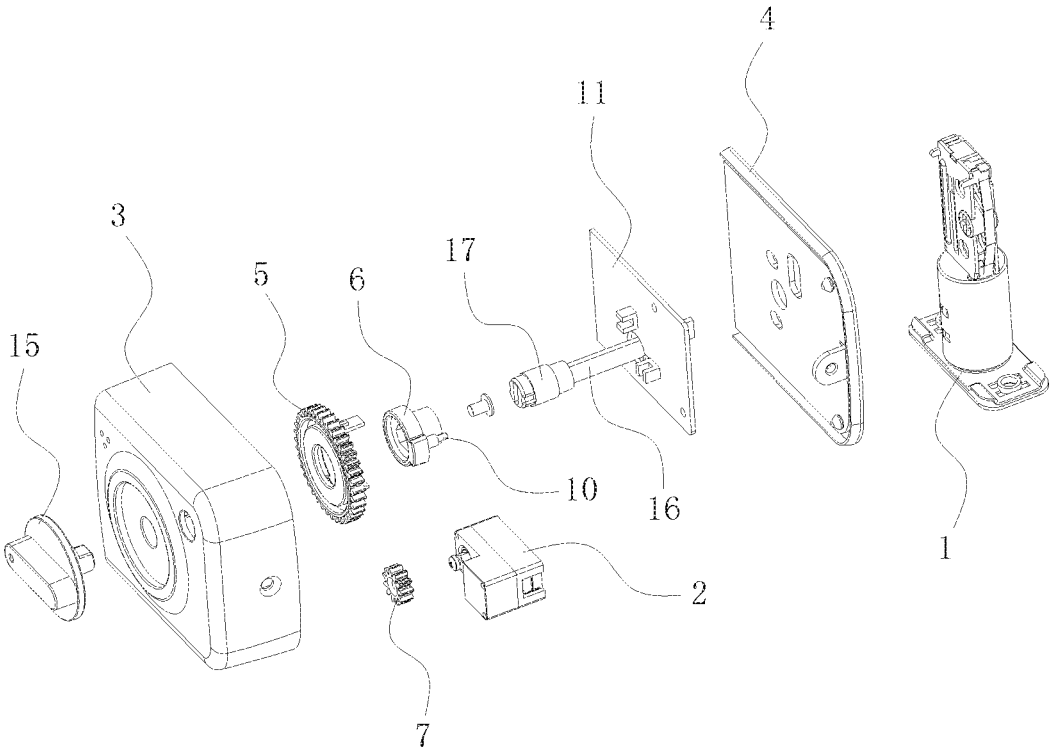
FIG. 1 is an exploded view of an electric lock device according to an embodiment of the present application.
Figure 2:
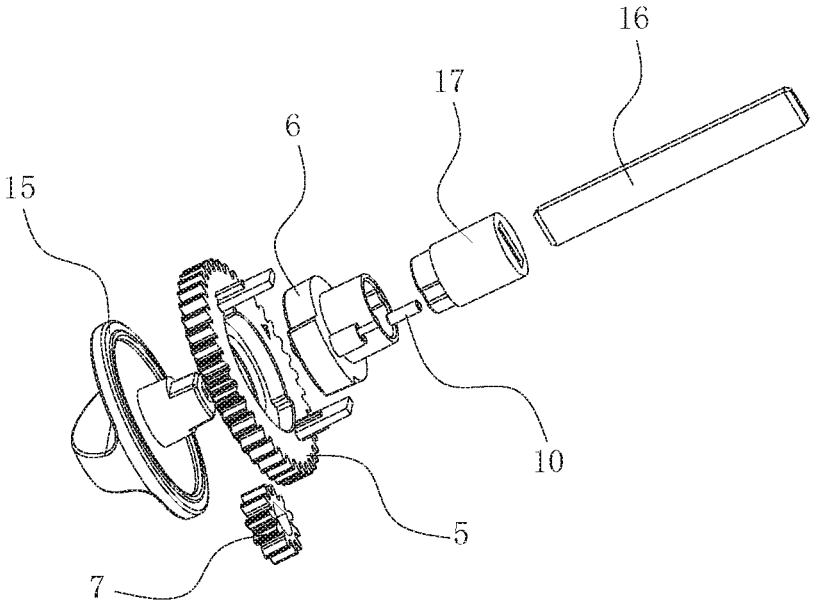
FIG. 2 is an exploded view of the clutch mechanism according to an embodiment of the present application.

1—Lock body, 2—Motor, 3—Front cover, 3.1—First mounting hole, 3.2—Annular protrusion, 4—Rear panel, 5—Driven gear, 5.1—Curved recess, 5.2—First through hole, 6—Turntable, 6.1—Arc-shaped bump, 6.2—First slot, 6.3—Second connection post, 6.4—Second slot, 6.5—Projection, 6.6—Communicating hole, 7—Driving gear, 8—First flap, 9—Second flap, 10—Magnetic column, 11—Circuit board, 11.1—Second through hole, 12—First sensor, 13—Second sensor, 14—Third sensor, 15—Knob, 15.1—First connection post, 15.2—Threaded hole, 16—Paddle, 17—Rotating shaft, 17.1—Recess portion, and 17.2—Jack.

DETAILED DESCRIPTION OF THE EMBODIMENTS

Technical solutions in embodiments of the present application are clearly and completely described hereinbelow with reference to accompanying drawings in the embodiments of the present application. It is obvious that the described embodiments are only a part of embodiments of the present application, rather than all the embodiments. All other embodiments obtained by those skilled in the art based on the embodiments of the present application without creative efforts shall fall within the protection scope of the present application.

As shown in FIGS. 1-4, an embodiment of the present application provides an electric lock device, mainly including a housing, a lock body 1, a motor 2, and a clutch mechanism. The housing is formed by assembling a front cover 3 and a rear panel 4, the motor 2 and the clutch mechanism is mounted inside the housing, and the lock body 1 is disposed outside the housing and behind the rear panel 4. The clutch mechanism includes a driven gear 5 and a turntable 6, which are arranged to be coaxial. An output shaft of the motor 2 is provided with a driving gear 7 meshing with the driven gear 5. A first side of the driven gear 5 defines a mounting position configured for allowing the turntable 6 to be embedded in. A sidewall of the mounting position defines an arc-shaped recess 5.1, and an outer sidewall of the turntable 6 defines an arc-shaped bump 6.1 corresponding to the arc-shaped recess 5.1. When the driven gear 5 and the turntable 6 rotate relative to each other, the arc-shaped bump 6.1 slides inside the arc-shaped recess 5.1; and when the driven gear 5 drives the turntable 6 to rotate together, an end sidewall of the arc-shaped recess 5.1 abuts on a sidewall of the arc-shaped bump 6.1. The central angle corresponding to the arc-shaped recess 5.1 is denoted as α, and the central angle corresponding to the arc-shaped bump 6.1 is denoted as β, and α and β satisfy: α−β≥180°. Therefore, a rotation virtual position greater than or equal to 180° exists between the driven gear 5 and the turntable 6, that is, the gear can be rotated backward by at least 180° regardless of the angle to which the gear rotates the turntable 6.

Figure 3:
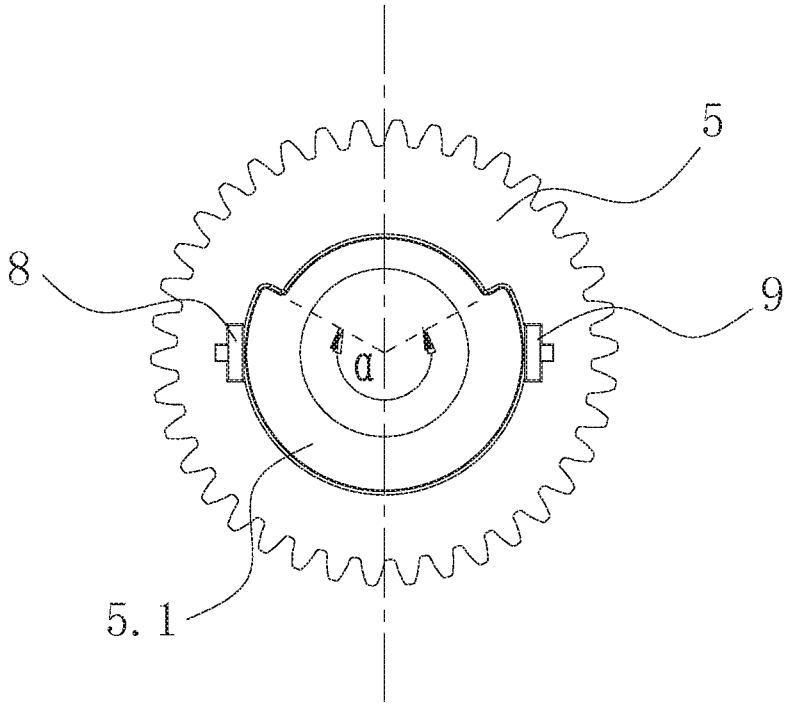
FIG. 3 is a schematic view showing the structure of a first side of a driven gear according to an embodiment of the present application.
Figure 4:
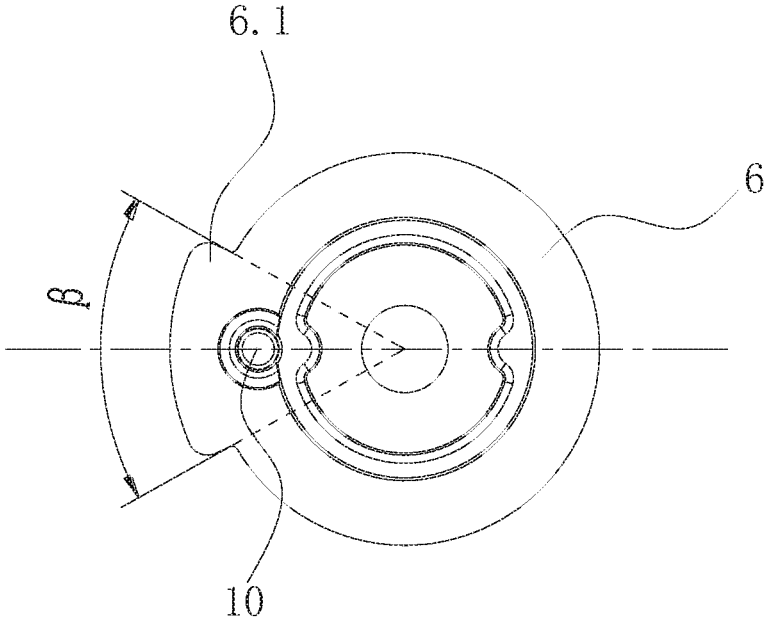
FIG. 4 is a schematic view showing the structure of a turntable according to an embodiment of the present application.
Figure 5:
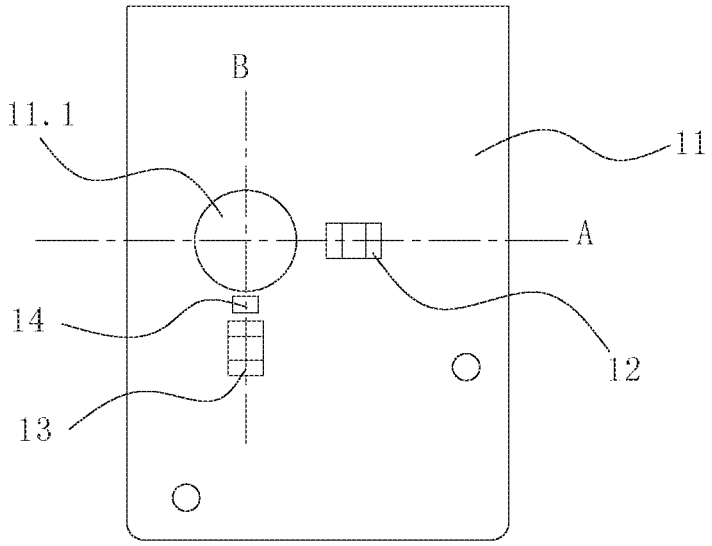
FIG. 5 is a schematic view showing the structure of a circuit board according to an embodiment of the present application.

Further, as shown in FIGS. 3-5, the first side of the driven gear 5 is provided with a first flap 8 and a second flap 9 symmetrically arranged about the center line of the arc-shaped recess 5.1, and a connecting line of the first flap 8 and the second flap 9 passes through an axis center of the driven gear 5. A magnetic column 10 is disposed at the turntable 6, and the magnetic column 10 is located at a center line of the arc-shaped bump 6.1. A circuit board 11 in electrical connection with the motor 2 is disposed in the housing, and the circuit board 11 is provided with a first sensor 12 and a second sensor 13 respectively configured for detecting the first flap 8 and the second flap 9 and a third sensor 14 configured for detecting the magnetic column 10. The function of the above structure lies in that the circuit board 11 detects the flaps and the magnetic column 10 by means of the respective sensors to determine rotational positions of the driven gear 5 and the turntable 6, so as to issue a forward or reverse rotation command to the motor 2, thereby realizing unlocking/locking and the function of retraction.

Figure 6:
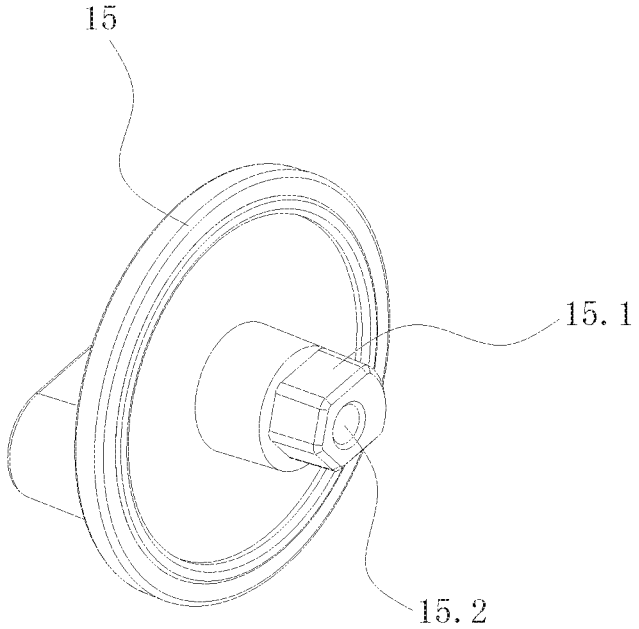
FIG. 6 is a schematic view showing the structure of a knob according to an embodiment of the present application.
Figure 7:
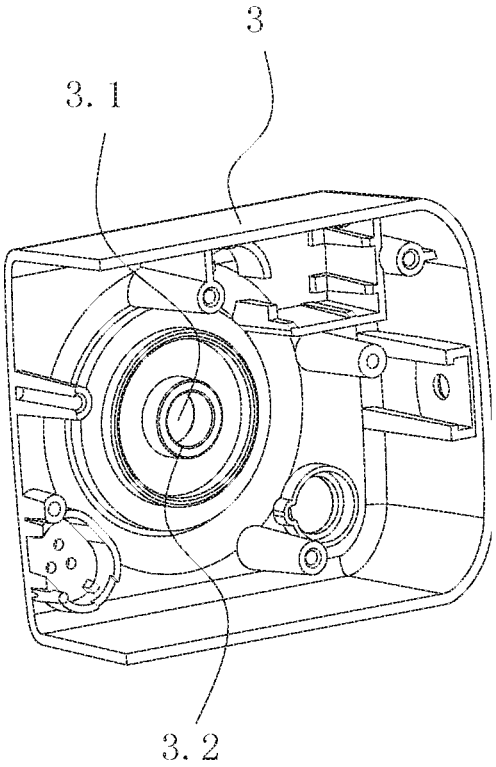
FIG. 7 is a schematic view showing the structure of a front cover according to an embodiment of the present application.
Figure 8:
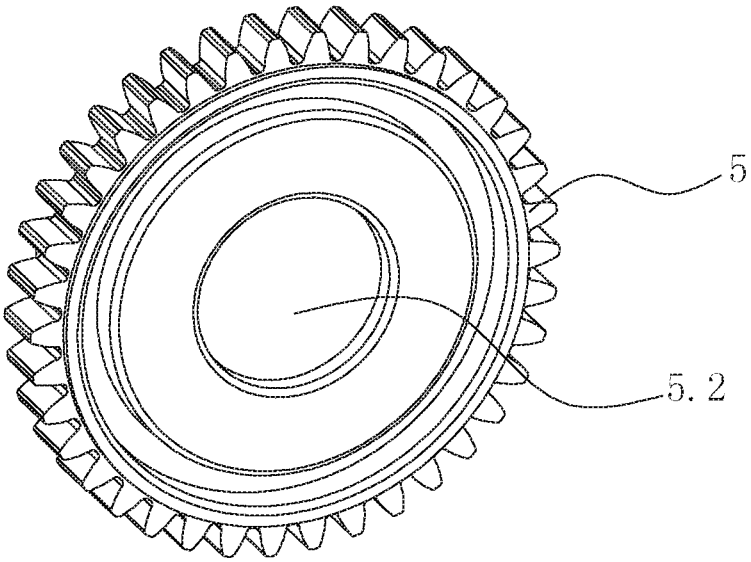
FIG. 8 is a schematic view showing the structure of a second side of a driven gear according to an embodiment of the present application.

Further, on the basis of FIG. 1, referring to FIGS. 6-8, the housing is provided with a rotatable knob 15. The knob 15 is provided with a polygonal first connection post 15.1, a front panel of the front cover 3 defines a first mounting hole 3.1, which is configured to allow the first connection post 15.1 to extend in, an axis center position of the driven gear 5 defines a first through hole 5.2 communicating with the mounting position, a side of the turntable 6 facing the driven gear 5 defines a first slot 6.2 corresponding to the first connection post 15.1, and the first connection post 15.1 passes through the first through hole 5.2 and is inserted into the first slot 6.2. Therefore, the knob 15 and the turntable 6 are fixedly connected, and the rotation of the knob 15 can rotate the turntable 6. Moreover, the edge of the first mounting hole 3.1 is provided with an annular protrusion 3.2 protruding into the housing, and the driven gear 5 is rotatably sleeved outside the annular protrusion 3.2.

Figure 9:
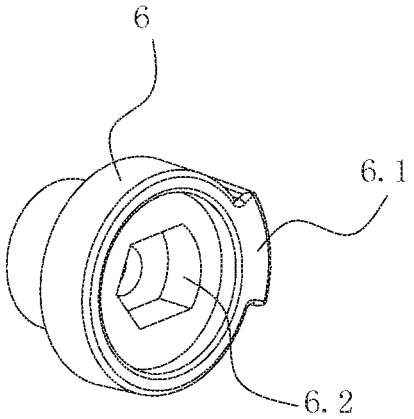
FIG. 9 is a schematic view showing the structure of a first slot on a turntable according to an embodiment of the present application.
Figure 10:
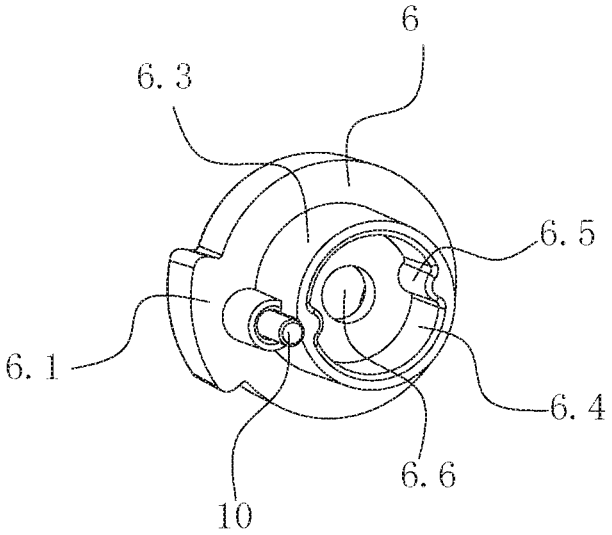
FIG. 10 is a schematic view showing the structure of a second slot on a turntable according to an embodiment of the present application.
Figure 11:
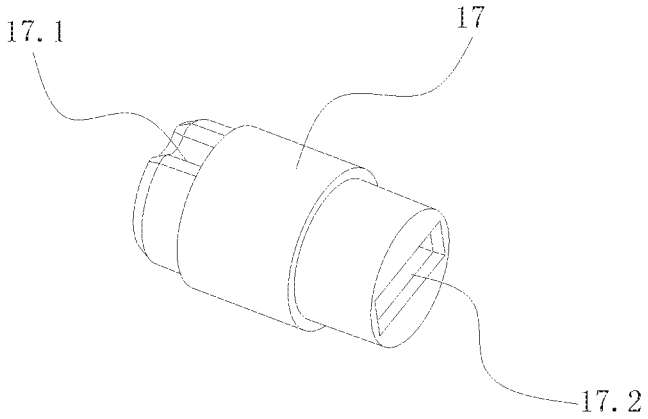
FIG. 11 is a schematic view showing the structure of a rotating shaft according to an embodiment of the present application.

Further, on the basis of FIG. 1, referring to FIGS. 9-11, a side of the turntable 6 facing away from the driven gear 5 is provided with a paddle 16 configured for controlling the unlocking/locking of the lock body 1. The paddle 16 is mounted at the turntable 6 via a rotating shaft 17, the circuit board 11 defines therein a second through hole 11.1 configured for allowing the rotating shaft 17 to pass therethrough, the first sensor 12 and the second sensor 13 are arranged around the second through hole 11.1, and the rear panel 4 of the housing defines a second mounting hole configured for allowing the rotating shaft 17 to pass therethrough. Specifically, the side of the turntable 6 facing away from the driven gear 5 is provided with a second connection post 6.3, and an end of the second connection post 6.3 away from the turntable 6 defines therein a second slot 6.4 configured for allowing the rotating shaft 17 to be inserted therein. Moreover, the sidewall of the second slot 6.4 is provided with a projection 6.5, and the outer sidewall of the rotating shaft 17 is provided with a recess portion 17.1 corresponding to the projection 6.5; the inside of the rotating shaft 17 is provided with a jack 17.2 for the insertion of the paddle 16. Thereby, the knob 15, the turntable 6, the rotating shaft 17 and the paddle 16 are fixedly connected, the rotation of the knob 15 can directly rotate the paddle 16, so as to realize the function of the manual unlocking/locking. Moreover, in order to make the connection between the knob 15 and the turntable 6 more secure, a communicating hole 6.6 is provided between the slot bottom of the first slot 6.2 and the slot bottom of the second slot 6.4, and the top end of the first connection post 15.1 is provided with a threaded hole 15.2, when the first connection post 15.1 is inserted into the first slot 6.2, the threaded hole 15.2 communicates with the communicating hole 6.6, and the screw can pass through the communicating hole 6.6 from the side of the second slot 6.4 and screw into the threaded hole 15.2, so as to fasten the first connecting post 15.1 to the turntable 6.

Referring to FIGS. 3-5, in order to achieve an optimal user experience, $\alpha$ and $\beta$ in the embodiments of the present application preferentially satisfy: $\alpha-\beta=180°$, a straight line passing through the first sensor 12 and perpendicular to the axis of the driven gear 5 is referred to as a first reference line A, a straight line passing through the second sensor 13 and perpendicular to the axis of the driven gear 5 is referred to as a second reference line B, the first reference line A is perpendicular to the second reference line B, and the third sensor 14 is located on the second reference line B.

Accordingly, on the basis of FIGS. 3-4, the present embodiment will describe the electric unlocking/locking process of the electric lock device hereinafter.

Figure 12:
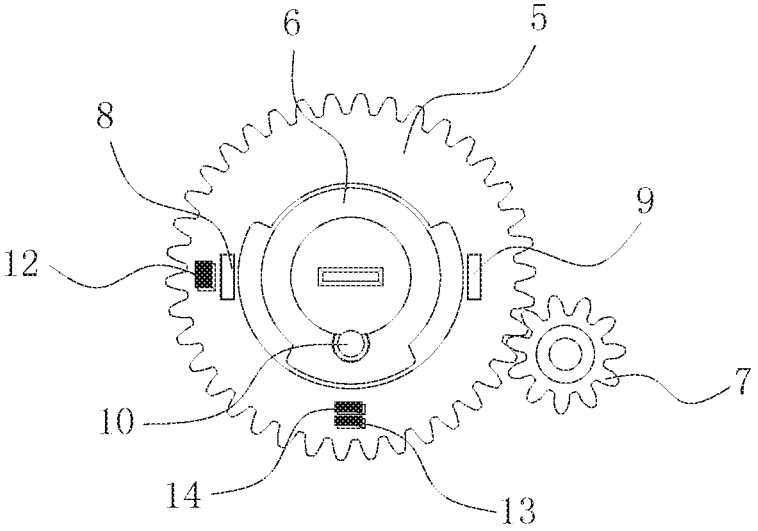
FIG. 12 is a schematic view (counterclockwise locking) of a clutch mechanism in an unlocked state after a retracting action according to an embodiment of the present application.
Figure 13:
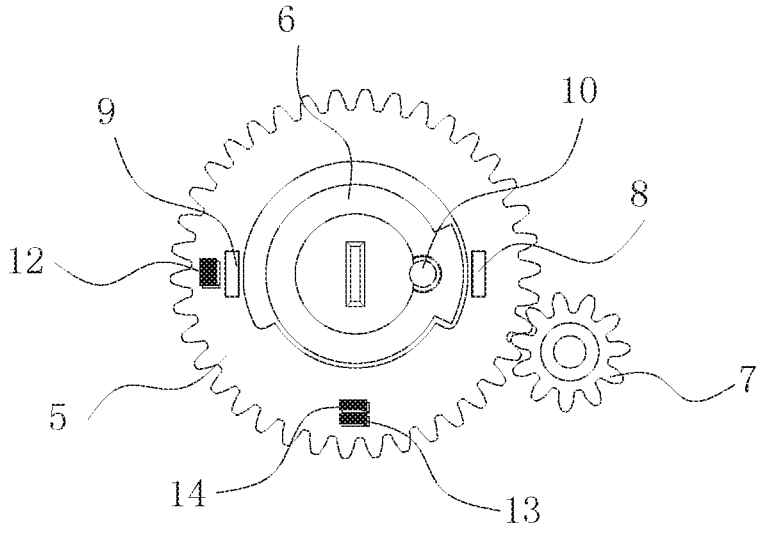
FIG. 13 is a schematic view (counterclockwise locking) of a clutch mechanism in a locked state before a retracting action according to an embodiment of the present application.

Locking process: as shown in FIG. 12, the first flap 8 is aligned with the first sensor 12, and the magnetic column 10 is aligned with the third sensor 14, at this time, the lock body 1 is in an unlocked state; when the motor 2 receives a locking command, it starts immediately and rotates clockwise, simultaneously the driven gear 5 is driven to rotate counterclockwise. When the first sensor 12 detects the second flap 9, the motor 2 is stopped. At this time, as shown in FIG. 13, the driven gear 5 just rotates by 180°, and the turntable 6 also rotates by 90° counterclockwise with the driven gear 5, the lock body 1 is thus switched to a locked state; then, the motor 2 performs a retracting action, that is, counterclockwise rotation, at the same time, the driven gear 5 is driven to rotate clockwise, when the first sensor 12 detects the first flap 8, the motor 2 is stopped again, at this time, as shown in FIG. 14, the driven gear 5 just rotates by 180° again, however, due to the presence of the arc-shaped recess 5.1, the turntable 6 is not driven, the lock body 1 remains locked, and the driven gear 5 is completely separated from the turntable 6, thereby the turntable 6 obtains a free rotation virtual position of 180° in the clockwise direction.

Figure 14:
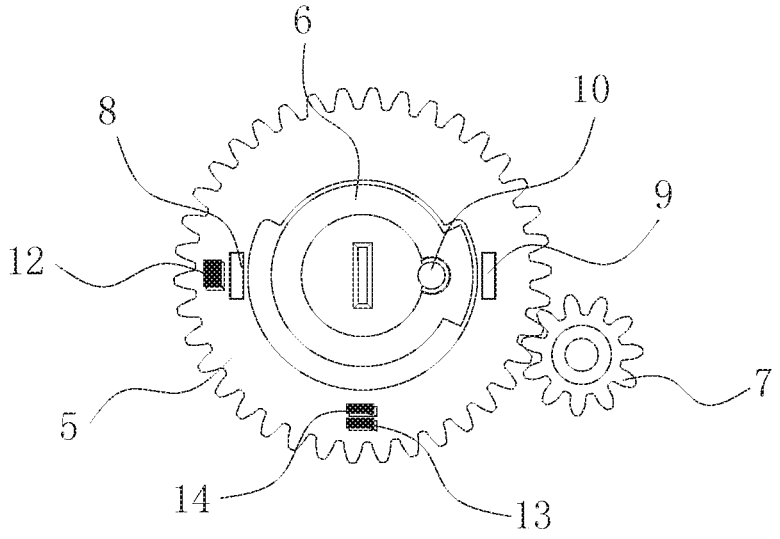
FIG. 14 is a schematic view (counterclockwise locking) of a clutch mechanism in a locked state after a retracting action according to an embodiment of the present application.
Figure 15:
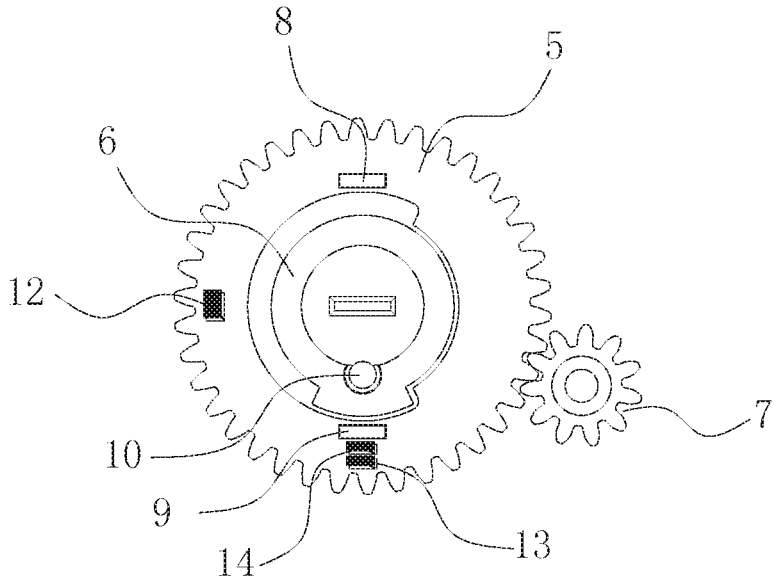
FIG. 15 is a schematic view (counterclockwise locking) of a clutch mechanism in an unlocked state before a retracting action according to an embodiment of the present application.

The unlocking process: as shown in FIG. 14, at this time, the lock body 1 is in a locked state; when the motor 2 receives a unlocking command, it starts immediately and rotates counterclockwise, and simultaneously drives the driven gear 5 to rotate clockwise, when the second sensor 13 detects the second flap 9, the third sensor 14 also detects the magnetic column 10, and the motor 2 is stopped, at this time, as shown in FIG. 15, the driven gear 5 just rotates by 90°, and the turntable 6 also rotates by 90° clockwise with the driven gear 5, the lock body 1 is thereby switched to a unlocked state; then, the motor 2 performs the retracting action, that is, clockwise rotation, at the same time, the driven gear 5 is driven to rotate counterclockwise, when the first sensor 12 detects the first flap 8, the motor 2 is stopped again, at this time, as shown in FIG. 12, the driven gear 5 just rotates by 90°, but due to the presence of the arc-shaped recess 5.1, the turntable 6 is not driven, the lock body 1 maintains the unlocked state, and the driven gear 5 is completely separated from the turntable 6, whereby the turntable 6 obtains a free rotation virtual position of 90° in both the clockwise direction and the counterclockwise direction.

Figure 16:
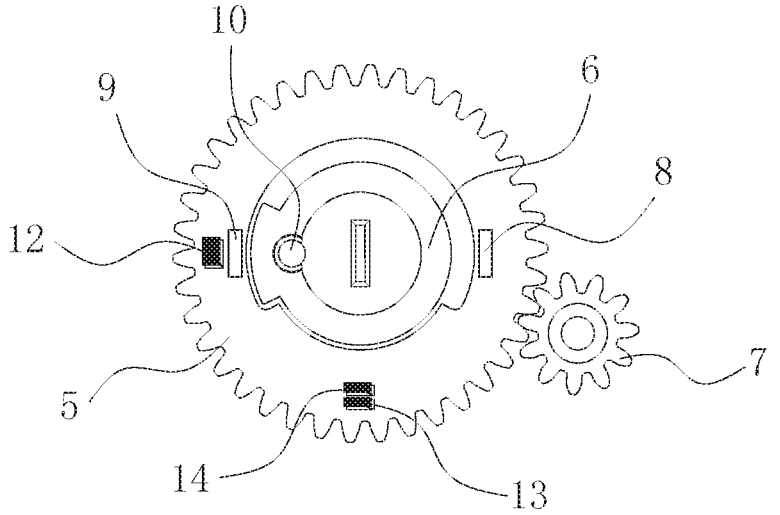
FIG. 16 is a schematic view (clockwise locking) of a clutch mechanism in a locked state before a retracting action according to an embodiment of the present application.
Figure 17:
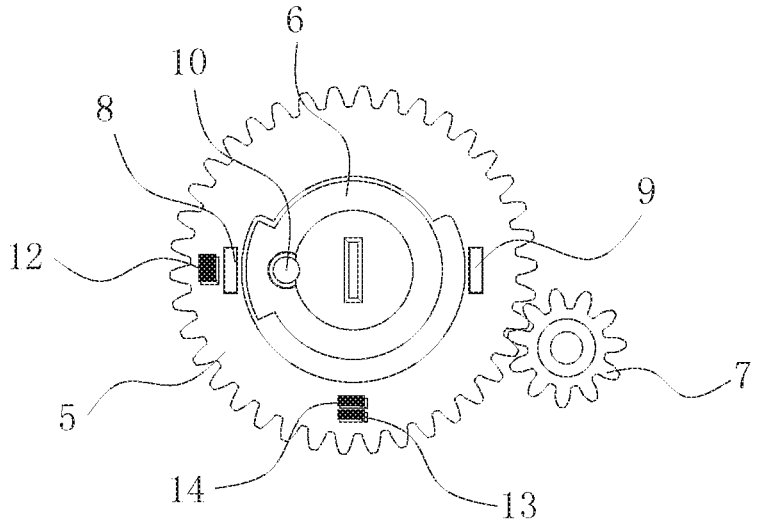
FIG. 17 is a schematic view (clockwise locking) of a clutch mechanism in a locked state after a retracting action according to an embodiment of the present application.
Figure 18:
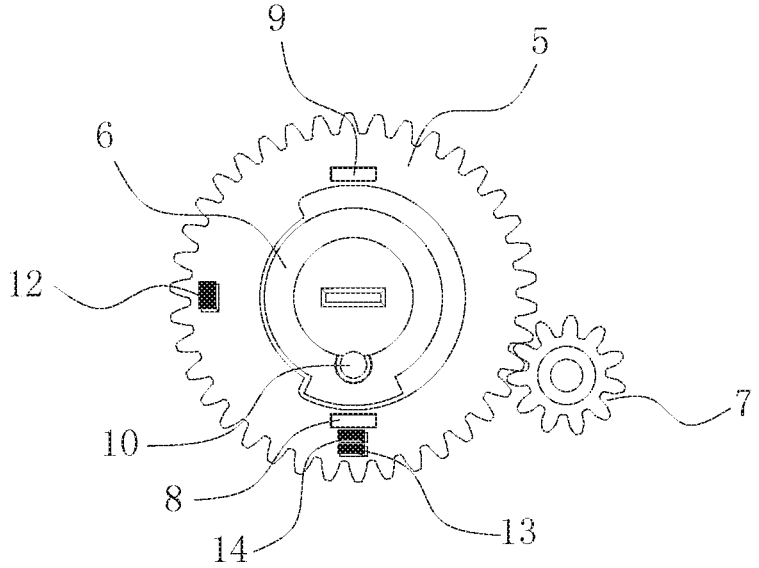
FIG. 18 is a schematic view (clockwise locking) of a clutch mechanism in an unlocked state before a retracting action according to an embodiment of the present application.

It should be noted that the aforesaid locking direction is counterclockwise (in the perspective of the drawings), of course, the locking direction can also be clockwise (in the perspective of the drawings), that is, the driven gear 5 rotates clockwise, and the turntable 6 is driven to the position as shown in FIG. 16, at this time, the lock body 1 can also be switched to a locked state; then, the motor 2 performs the retracting action, that is, clockwise rotation, and the turntable 6 is driven to the position as shown in FIG. 17, at this time, the driven gear 5 and the turntable 6 are completely separated to realize the retraction. Correspondingly, during the unlocking process, the driven gear 5 rotates counterclockwise, and the turntable 6 is driven to the position as shown in FIG. 18, and the lock body 1 is switched to a unlocked state; then, the motor 2 performs the retracting action, that is, counterclockwise rotation, the turntable 6 is driven to the position as shown in FIG. 12, at this time, the driven gear 5 and the turntable 6 are completely separated to realize the retraction.

Based on the above electric unlocking/locking process, the knob 15 of the electric lock device can stay in three positions, that is, two locking positions and one unlocking position, and the unlocked/locked states corresponding to the three positions are determined, so as to enable the user to identify the state of the lock device by silk printing unlocking/locking marks on the housing, which improves the convenience of the lock device; at the same time, two locking directions (counterclockwise locking and clockwise locking) also allows the lock device to be applied to both the left open door and the right open door, which improves the practicality of the lock device.

Finally, it should be noted that the first sensor 12 and the second sensor 13 in the embodiments of the present application both adopt photoelectric couplers, and the third sensor 14 is preferably a Hall sensor, of course, other sensors having similar functions may also meet the requirements for use.

In summary, the present application provides an electric lock device adopting a clutch mechanism composed of a driven gear 5 and a turntable 6, and the angle of retraction reaches 180°, compared with the prior art, having the advantages of high practicability, good hand feeling in operation, and no interference with the stability of power supply, with simple structure, simple control logic and low design cost.

It should be understood that the terms "first", "second", and the like are used in the present application to describe various information, these information should not be limited to these terms, but are only used to distinguish information with same type from each other. For example, a "first" information may also be referred to as a "second" information, and similarly, the "second" information may also be referred to as the "first" information, without departing from the protection scope of the present application.

The above are preferred embodiments of the present application, and it should be noted that those skilled in the art can also make several modifications and variations without departing from the principles of the present application. These modifications and variations are also considered to be within the protection scope of the present application.

What is claimed is:

1. An electric lock device, comprising: a housing, a lock body disposed outside the housing, and a motor and a clutch mechanism disposed inside the housing, wherein the clutch mechanism comprises a driven gear and a turntable, the driven gear and turntable being arranged to be coaxial; an output shaft of the motor is provided with a driving gear meshing with the driven gear; a first side of the driven gear defines a mounting position configured for allowing the turntable to be embedded in; a sidewall of the mounting position defines an arc-shaped recess, and an outer sidewall of the turntable defines an arc-shaped bump corresponding to the arc-shaped recess; a central angle corresponding to the arc-shaped recess is denoted as $\alpha$, and a central angle corresponding to the arc-shaped bump is denoted as $\beta$, $\alpha$ and $\beta$ satisfying: $\alpha-\beta\geq180°$;

the first side of the driven gear is provided with a first flap and a second flap symmetrically arranged about the center line of the arc-shaped recess, and a connecting line of the first flap and the second flap passing through an axis center of the driven gear;

a magnetic column is disposed at the turntable, and the magnetic column being located at a center line of the arc-shaped bump;

a circuit board electrically connected to the motor is disposed in the housing, and the circuit board is provided with a first sensor and a second sensor configured for detecting the first flap and the second flap respectively and a third sensor configured for detecting the magnetic column;

the housing is provided with a rotatable knob, the rotatable knob being fixedly connected to the turntable;

the side of the turntable facing away from the driven gear is provided with a paddle configured for controlling the unlocking/locking of the lock body.

2. The electric lock device according to claim 1, wherein $\alpha$ and $\beta$ satisfy: $\alpha-\beta=180°$.

3. The electric lock device according to claim 1, wherein a straight line passing through the first sensor and perpendicular to the axis of the driven gear is referred to as a first reference line, a straight line passing through the second sensor and perpendicular to the axis of the driven gear is referred to as a second reference line, the first reference line being perpendicular to the second reference line, and the third sensor being located on the second reference line.

4. The electric lock device according to claim 1, wherein the knob is provided with a first connection post, a front panel of the housing defines a first mounting hole, the first mounting hole being configured to allow the first connection post to extend in, an axis center position of the driven gear defines a first through hole communicating with the mounting position, a side of the turntable facing the driven gear defines a first slot, and the first connection post passes through the first through hole and is inserted into the first slot.

5. The electric lock device according to claim 4, wherein the edge of the first mounting hole is provided with an annular protrusion protruding into the housing, and the driven gear is rotatably sleeved outside the annular protrusion.

6. The electric lock device according to claim 1, wherein the paddle is mounted at the turntable by a rotating shaft, the side of the turntable facing away from the driven gear is provided with a second connection post, and an end of the second connection post away from the turntable defines therein a second slot configured for allowing the rotating shaft to be inserted therein.

7. The electric lock device according to claim 6, wherein the sidewall of the second slot is provided with a projection, and the outer sidewall of the rotating shaft is provided with a recess portion corresponding to the projection.

8. The electric lock device according to claim 6, wherein the circuit board is provided with a second through hole configured for allowing the rotating shaft to pass therethrough, the first sensor and the second sensor are arranged around the second through hole, and the rear panel of the housing defines a second mounting hole configured for allowing the rotating shaft to pass therethrough.

9. The electric lock device according to claim 1, wherein the first sensor and the second sensor are photoelectric couplers.

10. The electric lock device according to claim 1, wherein the third sensor is a Hall sensor.

* * * * *